US005361435A

United States Patent [19]

Reeves

[11] Patent Number: 5,361,435

[45] Date of Patent: Nov. 8, 1994

[54] PORTABLE BEACH TOWEL WITH SECURITY POCKET

[76] Inventor: Brian M. Reeves, 28501 La Falda, Laguna Niguel, Calif. 92677

[21] Appl. No.: 219,132

[22] Filed: Mar. 28, 1994

[51] Int. Cl.[5] ..... A47G 9/06

[52] U.S. Cl. ..... 5/419; 5/931

[58] Field of Search ..... 5/417–420, 5/485, 931

[56] References Cited

U.S. PATENT DOCUMENTS

| | | | |
|---|---|---|---|
| D. 258,035 | 1/1981 | Fenwick | D6/267 |
| D. 280,170 | 8/1985 | Short | D6/608 |
| 1,222,563 | 4/1917 | Rosenberg | 5/419 |
| 2,264,471 | 12/1941 | Glenn | 5/344 |
| 3,082,437 | 3/1963 | Upthagrove | 5/419 |
| 3,241,161 | 3/1966 | Dashosh | 5/490 |
| 3,689,947 | 9/1972 | Wolf | 5/344 |
| 4,195,378 | 4/1980 | Parker | 5/419 |
| 4,200,942 | 5/1980 | Case | 5/419 |
| 4,231,125 | 11/1980 | Tittl | 5/419 |
| 4,546,507 | 10/1985 | Weinstein | 5/419 |
| 4,980,935 | 1/1991 | Kazanowski et al. | 5/419 |
| 5,010,610 | 4/1991 | Ackley | 5/420 |

*Primary Examiner*—Alexander Grosz

*Attorney, Agent, or Firm*—Macro-Search Corp.

[57] ABSTRACT

A portable beach towel with a built-in hidden pouch for storing valuables is disclosed. The towel comprises an elongated rectangular fabric portion having top and bottom surfaces, top and bottom end edges, and side edges. A pair of elastic loops and a carrying strap are sewn onto the bottom surface near the bottom edge. A pocket is formed by folding the top end edge over the top surface, thereby defining an enclosure space for holding an elongated rod-shaped pillow made from a soft, compliant material. An access aperture between the top end edge and the top surface opens into the pouch, which is sewn into the pocket. The aperture can be closed with a zipper or other suitable type of closure. In use, with the towel resting upon the ground, the access aperture is normally hidden from view from passers by.

5 Claims, 2 Drawing Sheets

PORTABLE BEACH TOWEL WITH SECURITY POCKET

FIELD OF THE INVENTION

This invention relates generally to beach towels, and, more particularly, is directed towards a portable beach towel that includes a security pocket.

BACKGROUND OF THE INVENTION

A variety of beach towel devices exist that include built-in head rest means, such as that found in U.S. Pat. Nos. 4,980,935 to Kazanowski et al. on Jan. 1, 1991; 4,546,507 to Weinstein on Oct. 15, 1985; 4,231,125 to Tittl on Nov. 4, 1980; 4,200,942 to Case on May 6, 1980; 3,689,947 to Wolf on Sep. 12, 1972; and Des. 280,170 to Short on Aug. 20, 1985. Such devices typically have a pocket for receiving a pillow. While such devices are suitable for providing additional comfort to the user over that of a conventional beach towel by providing a pillow, there is little provision for storing other items with the pillow. Typically such devices provide only enough room for the pillow, with little room left over for storing other items such as keys, wallets, and the like. If one were to store such items with the pillow, the outline of such items would in many cases be readily visible to passers by. Further, the opening for inserting the pillow into a pocket of such devices is generally in plain sight, which makes any valuable items in the pocket more susceptible to theft.

Other prior art beach towel devices, such as that taught in U.S. Pat. Nos. 2,264,471 to Glenn on Dec. 2, 1941, and Des. 258,035 to Fenwick on Jan. 27, 1981, teach a beach towel with a pocket for storing items other than pillows. However, such pockets are again readily apparent to casual observers, and tend to direct attention to the outlines visible in the fabric of such devices of any items that may be stored therein. Such devices increase the probability of theft of the stored articles since such stored articles are visibly apparent. Further, these types of pillow-less devices do not provide a comfortable means for resting one's head.

Clearly, then, there is a need for a beach towel device that includes a comfortable pillow, and further provides a hidden storage compartment for storing valuables that is not readily visible to casual observers. When keys or other rigid items are stored in the storage compartment, the pillow would be positioned between such items and the user's head. Further, such a needed device would be readily rolled-up into a convenient carrying configuration, and would be washable upon removing the pillow. The present invention fulfills these needs and provides further related advantages.

SUMMARY OF THE INVENTION

The present invention is a portable beach towel with a built-in hidden pouch for storing valuables. The towel comprises an elongated rectangular fabric portion having top and bottom surfaces, top and bottom end edges, and side edges. A pair of elastic loops and a carrying strap are sewn onto the bottom surface near the bottom edge. A pocket is formed by folding the top end edge over the top surface, thereby defining an enclosure space within the pocket for holding an elongated rod-shaped pillow made from a soft, compliant material. An access aperture between the top end edge and the top surface opens into the pouch, which is sewn into the pocket. The aperture can be closed with a zipper or other suitable closure means. In use, with the towel resting upon the ground, the access aperture is normally hidden from view from passers by.

The present invention is a beach towel device that includes a comfortable pillow, and further provides a hidden storage compartment for storing valuables that is not readily visible to casual observers. When keys or other rigid items are stored in the storage compartment, the pillow is positioned between these items and the user's head, improving comfort to the user. Further, the present invention is readily rolled-up into a convenient carrying configuration, and is easily washed upon removing the pillow. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figures 1A, 1B:
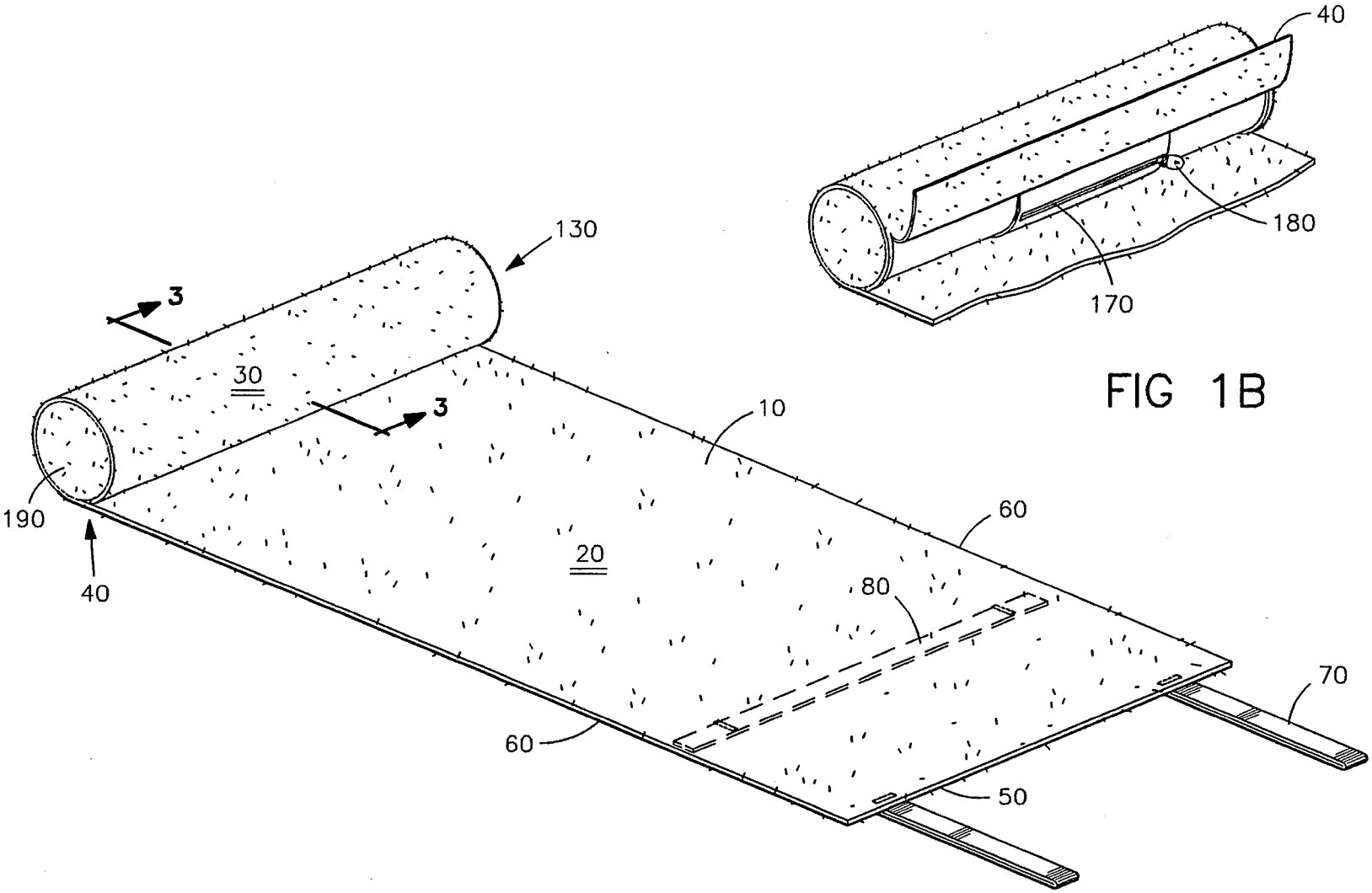
FIG. 1A is a perspective illustration of a beach towel with a hidden security pocket, illustrating a fabric portion of the towel with a pillow at a top end and a pair of elastic loops at a bottom end.
FIG. 1B is a partial perspective view of FIG. 1A showing the fabric portion raised to reveal the hidden pocket of the invention.
Figure 2:
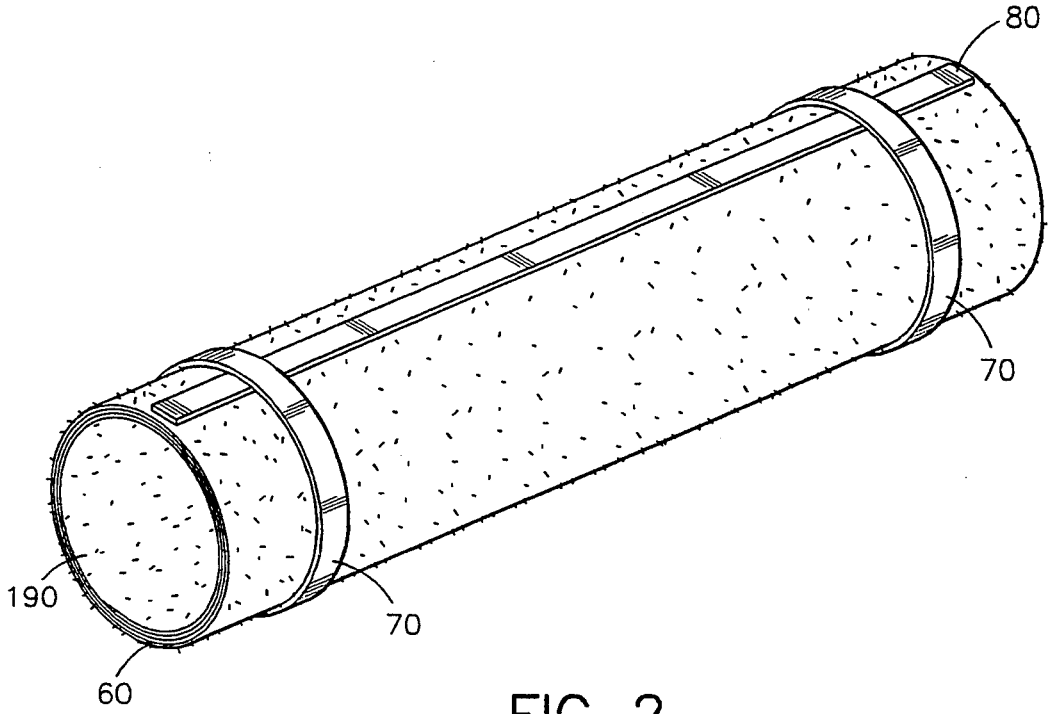
FIG. 2 is a perspective illustration of the invention, illustrating the device in a rolled configuration, and further showing a carrying strap.

FIGS. 1A, 1B and 2 show a beach towel comprising an elongated, water-absorbent fabric portion 10 having a top surface 20 and a bottom surface 30. The portion 10 defines an opposing, substantially parallel, laterally extending top end edge 40 and bottom end edge 50 (FIG. 1A). The portion 10 further defines opposing, substantially parallel, laterally extending side edges 60 that are orthogonally juxtaposed with both the top end edge 40 and the bottom end edge 50.

A pair of spaced apart loops 70 made of elastic material are fastened to the bottom surface 30 of the portion 10 near the bottom end edge 50 and extending therefrom. A carrying strap 80 is fastened to the bottom surface 30 near the bottom end edge 50 and extending between the side edges 60.

Figure 3:
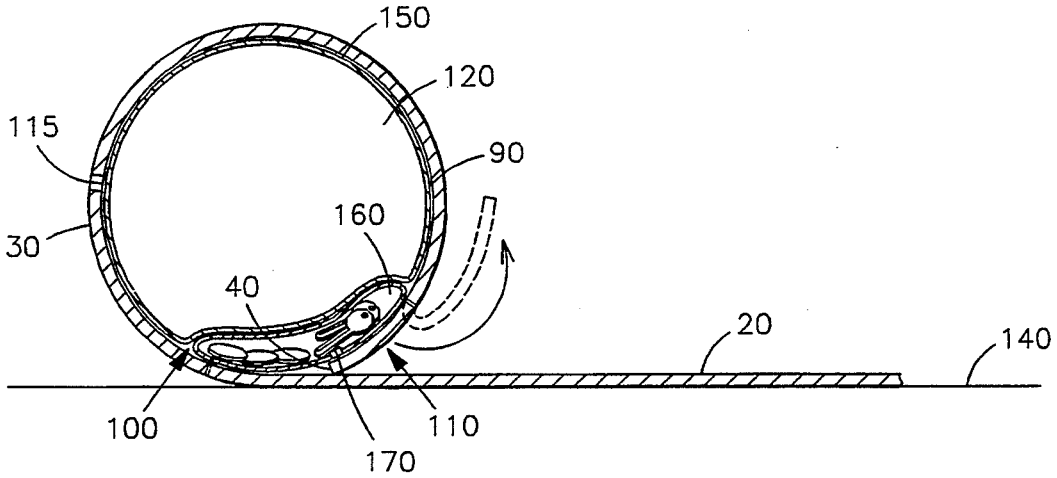
FIG. 3 is a cross-sectional view of the invention, taken generally along line 3—3 of FIG. 1A, and illustrating a pouch and a pillow contained in a pocket formed by the fabric portion.

A cylindrical pocket 90 is formed by folding the top end edge 40 over the top surface 20. The pocket 90 extends between the side edges 60 in such a manner as to form an enclosure space 100 within the pocket 90. An access aperture 110 is formed between the top end edge 40 and the top surface 20 in order to provide access to the enclosure space 100. A pillow 120 of soft compliant material is shaped as an elongated rod of a size and conformation to fit within the pocket 90, thereby forming a head rest means 130 (FIG. 1). The pillow 120 may include a water repellent cover 150, or may itself be made from a water repellent material. The pocket 90 takes the shape of the pillow 120 in such manner as to position the access aperture 110 beneath the pillow 120 so that the access aperture 110 is normally hidden from view when the towel is rested upon a generally flat surface 140 (FIG. 3). End pieces 190 made from the same fabric material as the fabric portion 10 may be sewn along the side edges 60 of the pocket 90 for enclosing the ends of the pocket 90.

A pouch 160 may be further included in the pocket 90 for storing belongings. The pouch 160 is fastened, such as by sewing, so that the aperture 110 opens into the pouch 160. In such an embodiment, an additional access aperture 115 may be included on the bottom surface 30 and into the enclosed space 100 for providing separate access to the enclosed space 100 for inserting and removing the pillow 120, for example. Each aperture 110,115 preferably includes an aperture closure means 170, such as a two-part mechanical means such as a zipper, or a hook-and-loop type fastener. A locking device 180, such as a small suitcase-type padlock, may be included for preventing unauthorized opening of the closure means 170.

In use, the towel rests upon the flat surface 140 as shown in FIG. 1. A person may lay on the towel with his head resting on the head rest means 130. The person may keep belongings, such as currency, keys, and the like, in the pouch and out of view of passers by. The towel may be rolled-up into a rolled configuration, as shown in FIG. 2, for convenient carrying. In the rolled configuration, the fabric portion 10 is rolled around the pocket 90, and each elastic loop 70 is stretched over its nearest side edge 60 so as to hold the towel therein. The carrying strap 80 is sewn onto the fabric portion 10 at locations approximately corresponding to the elastic loops 70, so that while carrying the rolled-up towel the carrying strap 80 does not pull at the elastic loops 70.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A beach towel comprising:

an elongated, water-absorbent fabric portion having a top surface and a bottom surface, and defining opposing, substantially parallel, laterally extending top and bottom ends with edges, and in orthogonal juxtaposition thereto, opposing, substantially parallel, laterally extending side edges;

a pair of spaced apart loops of elastic material, each of the loops being fastened to the bottom surface near the bottom end edge and extending therefrom;

a carrying strap fastened to the bottom surface near the bottom end edge and extending between the side edges;

a pocket formed by folding the top end edge over the top surface, the pocket extending between the side edges in such manner as to form an enclosure space within the pocket and further providing an access aperture between the top end edge and the top surface;

a pillow of a soft compliant material shaped as an elongated rod of a size and conformation to fit within the pocket providing a head rest means, the pocket taking the shape of the pillow in such manner as to position the access aperture beneath the pillow so that the access aperture is normally hidden from view when the towel is rested upon a generally flat surface, the pocket further including a pouch for storing belongings, the pouch being fastened such that the aperture opens into the pouch, the top end of the fabric portion forming a movable flap for covering the aperture.

2. The towel of claim 1 wherein the pillow is made of a water repellent material.

3. The towel of claim 1 wherein the pillow further includes a cover of water repellent material.

4. The towel of claim 1 further including aperture closure means.

5. The towel of claim 4 wherein the aperture closing means is a two-part mechanical means and further includes a locking device for preventing unauthorized opening of the closure means.

* * * * *